US006959840B2

(12) United States Patent
Iwatsubo

(10) Patent No.: US 6,959,840 B2
(45) Date of Patent: Nov. 1, 2005

(54) CAP FOR DOUBLE CONTAINER

(75) Inventor: Mitsugu Iwatsubo, Tokyo (JP)

(73) Assignee: Kao Corporation, Tokyo (JP)

( * ) Notice: Subject to any disclaimer, the term of this patent is extended or adjusted under 35 U.S.C. 154(b) by 359 days.

(21) Appl. No.: 10/258,617

(22) PCT Filed: Apr. 16, 2001

(86) PCT No.: PCT/JP01/03237

§ 371 (c)(1),
(2), (4) Date: Nov. 6, 2002

(87) PCT Pub. No.: WO02/10030

PCT Pub. Date: Feb. 7, 2002

(65) Prior Publication Data

US 2003/0089735 A1 May 15, 2003

(30) Foreign Application Priority Data

Aug. 1, 2000 (JP) ..... 2000-233581

(51) Int. Cl.[7] ..... B65D 35/22; B67D 5/60; B67D 3/00

(52) U.S. Cl. ..... 222/94; 222/95; 222/130; 222/212; 222/484; 222/525

(58) Field of Search ..... 222/94, 95, 105, 222/130, 212, 397, 481–484, 489, 522, 523, 525

(56) References Cited

U.S. PATENT DOCUMENTS

| | | | | |
|---|---|---|---|---|
| 4,420,100 A | * | 12/1983 | Mueller | 222/205 |
| 5,033,654 A | * | 7/1991 | Bennett | 222/190 |
| 5,615,803 A | | 4/1997 | Hatakeyama et al. | |
| 5,927,565 A | * | 7/1999 | Paczonay | 222/484 |

FOREIGN PATENT DOCUMENTS

| | | |
|---|---|---|
| JP | 9-286445 | 11/1996 |
| JP | 11-189251 | 7/1999 |

* cited by examiner

*Primary Examiner*—Gene Mancene
*Assistant Examiner*—Patrick Buechner
(74) *Attorney, Agent, or Firm*—Oblon, Spivak, McClelland, Maier & Neustadt, P.C.

(57) ABSTRACT

A cap to be fitted on a double container including a flexible outer container and an inner bag, being composed of a main cap which has a flow opening for discharging the contents and is fixedly fitted on the neck of the double container and a nozzle cap which has an outlet for discharging the contents and is slidably fitted on the main cap. The cap makes a switch between a state with a flow passage shut and a ventilation passage open and a state with the flow passage open and the ventilation passage shut by vertical sliding movement of the nozzle cap on the main cap.

6 Claims, 4 Drawing Sheets

CAP FOR DOUBLE CONTAINER

TECHNICAL FIELD

The present invention relates to a cap to be fitted on a double container which has a flexible outer container and an inner bag containing the contents with a space between the outer container and the inner bag.

BACKGROUND ART

A double container having a flexible outer container and an inner bag containing the contents with a space between the outer container and the inner bag is capable of retaining the shape of the outer container even when the inner bag is deformed with a decrease of its volume according as the contents are consumed.

In case where the contents of such a double container comprise a component which decomposes to generate gas, there is a fear that the decomposition gas expands and bursts the container during storage. It is therefore necessary to make a ventilation passage interconnecting the inside of the container to the open air so as to let out the decomposition gas. Further, it is desirable that the space of the container be ventilated through a ventilation passage during storage.

On use of the double container, on the other hand, it is necessary to shut the ventilation passage to keep in air or gas of the space so that a pressing force imposed to the outer container may be transmitted to the inner bag, whereby the contents can be discharged from the tip of the cap fitted on the container.

DISCLOSURE OF THE INVENTION

It is an object of the present invention to provide a cap for a double container which makes it possible to achieve ventilation of the space during storage and discharge of the contents on use through an easy switching operation.

The above object of the present invention is accomplished by providing a cap for a double container comprising a flexible outer container and an inner bag for containing the contents with a space between the outer container and the inner bag and having in the neck thereof a ventilation hole interconnecting with the space, wherein the cap is composed of a main cap which has a flow opening and is fixedly fitted on the neck of the double container and a nozzle cap which has a discharge outlet and is slidably fitted on the main cap, and the cap has a flow passage switching means for opening and shutting the flow passage of the contents from the flow opening to the discharge outlet by sliding movement of the nozzle cap on the main cap and a ventilation passage switching means for opening and shutting a ventilation passage from the ventilation hole to open air outside the double container by the sliding movement such that the sliding movement makes a switch between a state with the flow passage shut and the ventilation passage open and a state with the flow passage open and the ventilation passage shut.

BRIEF DESCRIPTION OF THE DRAWINGS

FIG. 1 is a cross-section of a double container with a cap according to a first embodiment of the present invention fitted on.

FIG. 2(*b*) is a cross-section of the essential part of a double container with a cap according to the first embodiment of the present invention fitted on, the container being on use.

FIG. 4(*b*) is a cross-section of the essential part of a double container with a cap according to the second embodiment of the present invention fitted on, the container being on use.

BEST MODE FOR CARRYING OUT THE INVENTION

Figure 1:
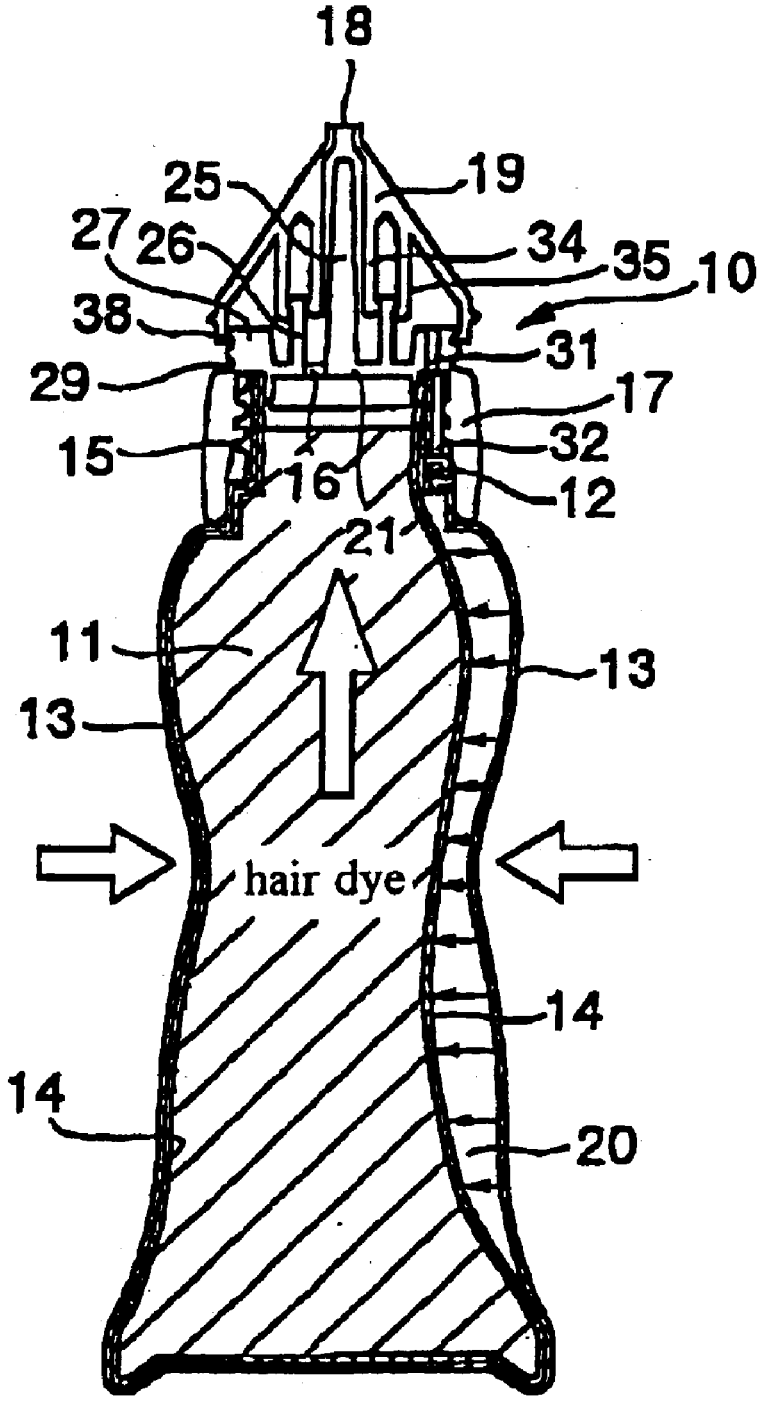

As shown in FIG. 1, a cap 10 for a double container according to the first preferred embodiment of the present invention is used as fitted on the neck 15 of a bottle 11 which is a double container holding, for example, hair dye as contents. The bottle 11 is a laminated and separated container composed of a flexible outer container 13 and an inner bag 14 containing hair dye, with a space 20 between the outer container 13 and the inner bag 14. The neck 15 of the bottle 11 has a ventilation hole 12 which interconnects with the space 20.

The outer container 13 is, for example, a polyethylene container having an almost cylindrical shape. The outer container 13 is flexible such that it is deformed flat when held and pressed in a hand. It also has such shape retention as to spontaneously restore its original almost cylindrical shape when relieved from the pressed state. The upper projection of the outer container 13 forms the neck 15 having a male thread on its outer peripheral surface. The neck 15 has a ventilation hole 12 in approximately the middle of its height.

The inner bag 14 is, for example, a polystyrene bag container having a thickness of about 100 $\mu$m. The inner bag 14 is inserted in the outer container 13 with separably intimate contact with the inner wall of the outer container 13 except the part right below the ventilation hole 12. The inner bag 14 and the outer container 13 constitute a double container. The non-contact part right below the ventilation hole 12 forms the space 20 between the outer container 13 and the inner bag 14, the space 20 connecting with the ventilation hole 12.

According to the first embodiment, the hair dye put into the inner bag 14 contains a component which generates $O_2$ by decomposition of $H_2O_2$ and a volatile component such as water or an alcohol. The polystyrene inner bag 14, in which the hair dye is held, has a permeability to $O_2$, a decomposition gas, as high as about 0.5 to 5.0 at a measuring temperature of 25° C. The permeability of the inner bag 14 to decomposition gases is measured by "Testing method for gas transmission through plastic film and sheeting—Method A (differential pressure method)" specified in JIS K7126.

Figure 2:
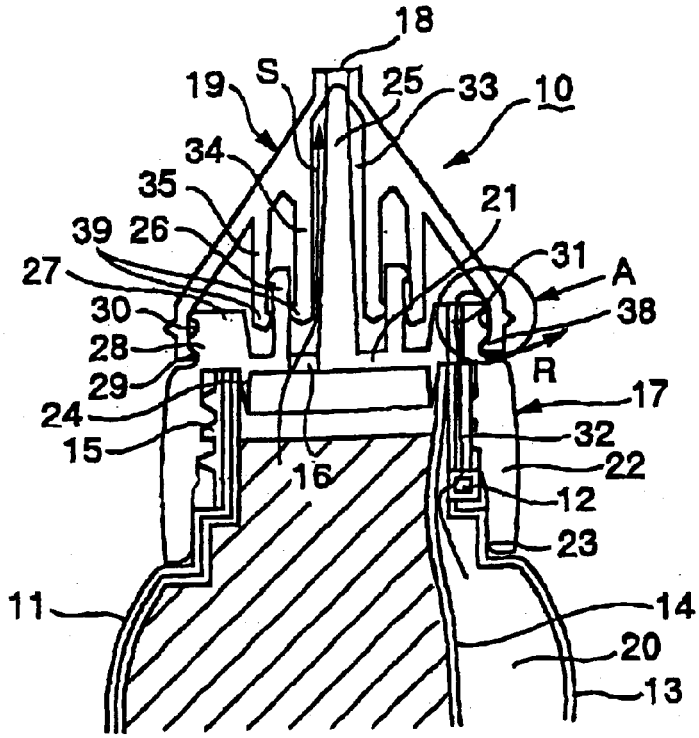
FIG. 2(*a*) is a cross-section of the essential part of a double container with a cap according to the first embodiment of the present invention fitted on, the container being in storage.
Figure 2:
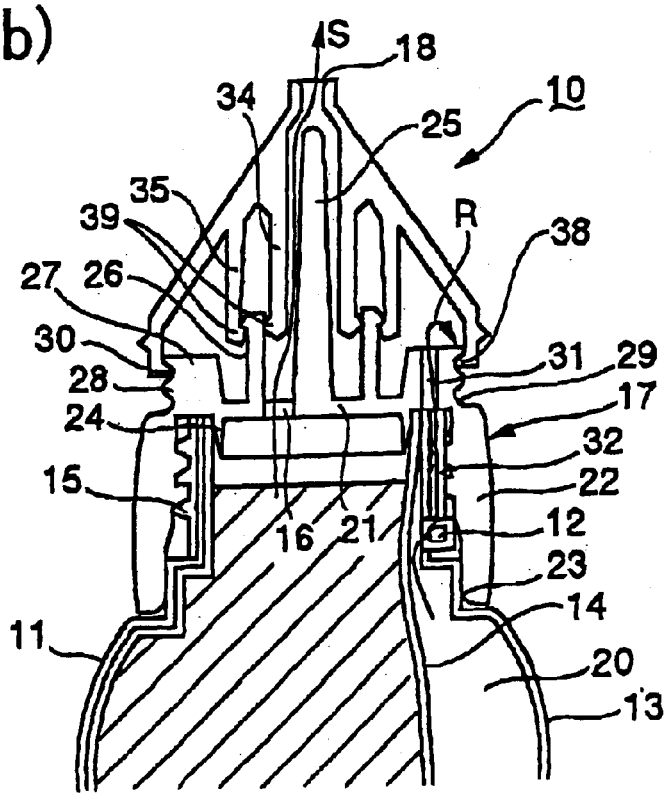

As shown in FIGS. 2(*a*) and (*b*), the cap 10 for double container according to the first embodiment is composed of a main cap 17 and a nozzle cap 19, wherein the main cap 17 has a hair dye flow opening 16 and is fixedly fitted on the neck 15 of the bottle 11, and the nozzle cap 19 has a hair dye discharge outlet 18 and is vertically slidably fitted on the main cap 17. The cap 10 has a flow passage switching means for opening and shutting the hair dye flow passage S from the flow opening 16 to the discharge outlet 18 by sliding movement of the nozzle cap 19 on the main cap 17 and a ventilation passage switching means for opening and shutting the ventilation passage R from the ventilation hole 12 to open air outside the bottle 11 by the sliding movement of the nozzle cap 19 on the main cap 17. The cap 10 is designed to make a switch by vertical sliding movement of the nozzle cap 19 between a state (a) with the flow passage S shut and the ventilation passage R open and a state (b) with the flow passage S open and the ventilation passage R shut.

The main cap 17 is a cylindrical member, the upper end of which is closed by a top plate 21, and the cylindrical wall 22 of which is provided with a female thread on the inner peripheral surface thereof The female thread is screwed on the male thread of the neck 15 to fixedly fit the main cap 17 to the neck 15. In the fixedly fitted state, the main cap 17 has its inner side at the lower end thereof in tight contact with the outer periphery of a basal part 23, which is the basal part of the neck 15 of the bottle 11 with an increased diameter. Thus, air passage between the inner side of the lower end of the main cap 17 and the outer periphery of the basal part 23 is shut off. The inner side of the top plate 21 is provided with a projection forming an inner ring 24, which is plugged in the upper opening of the neck 15.

A rod plug 25 for shutting and opening the discharge outlet, which constitutes the flow passage switching means, projects upward from the center on the outer side of the top plate 21 of the main cap 17. An annular guide wall 26 also projects upward to concentrically surround the rod plug 25. The annular guide wall 26 is to be snap fitted in between an inner annular wall 34 and an outer annular wall 35 of the nozzle cap 19 described later to guide the vertical sliding movement of the nozzle cap 19. The top plate 21 also has an annular catching wall 27 projecting upward on the outer side thereof concentrically with the rod plug 25 to surround the annular guide wall 26. The annular catching wall 27 has formed on the outer peripheral surface thereof a lower annular deep groove 29 and an upper annular shallow groove 30, forming an annular curved protrusion 28 therebetween. A flow opening 16 (an outlet for the hair dye from the bottle 11) is bored in the top plate 21 at a position between the rod plug 25 and the annular guide wall 26. The annular catching wall 27 has a gas-leading hole 31 vertically piercing therethrough. A gas-leading channel 32 is formed on the outer side of the neck 15 vertically across the male thread at the position where the ventilation hole 12 is bored. With the main cap 17 fixedly fixed on the neck 15, the gas-leading hole 31 connects with the gas-leading channel 32.

The nozzle cap 19 has a conical shape with its vertex open as the discharge outlet 18. A cylindrical inner wall 34 forming a central flow path 33 is provided in the central portion on the inner side of the nozzle cap 19. An outer annular wall 35 is provided concentrically outside the cylindrical inner wall 34. The inner cylindrical wall 34 and the outer annular wall 35 are positioned so as to have the annular guide wall 26 of the main cap 17 snapped in therebetween and guide the vertical sliding movement of the nozzle cap 19 while keeping the concentricity with the main cap 17. The lower end each of the cylindrical inner wall 34 and the outer annular wall 35 projects toward the annular guide wall 26 to form an annular contact projection 39 along the lower end. As a result, with no gap between the annular guide wall 26 and the annular outer wall 35 or the cylindrical inner wall 34, the pass of the hair dye is shut off. On use of the container, the hair dye having flown into the inside of the cap 10 is thus made to flow smoothly to the discharge outlet 18 through the central flow path 33.

Figure 3:
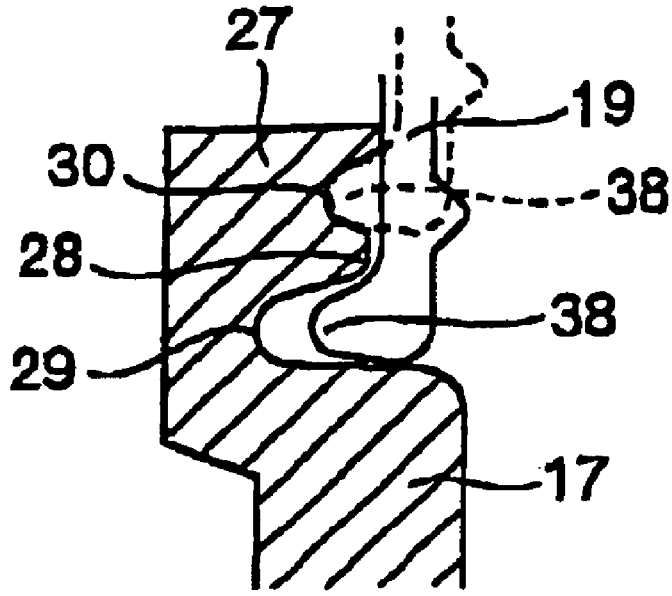
FIG. 3 is an enlarged view of portion A in FIG. 2(*a*), with which to illustrate a ventilation passage switching means of a cap for double container according to the first embodiment of the present invention.

The lower opening edge of the nozzle cap 19 projects radially inward to form an annular switch projection 38 for opening and shutting the ventilation passage. The inner diameter of the annular switch projection 38 is slightly larger than the outer diameter of the lower annular deep groove 29, which is formed on the outer peripheral surface of the annular catching wall 27, and is slightly smaller than the outer diameter of the upper annular shallow groove 30. Accordingly, as shown in FIG. 3, when the annular switch projection 38 is in the lower annular deep groove 29 of the annular catching wall 27, and the discharge outlet 18 is plugged with the rod plug 25, the lower annular deep groove 29 provides the annular switch projection 38 with a loose fit, leaving a gap to secure ventilation (see FIG. 2(*a*)). When the annular switch projection 38 is in the upper annular shallow groove 30 of the annular catching wall 27 to open the discharge outlet 18, the upper annular shallow groove 30 provides the annular switch projection 38 with a tight fit, shutting off ventilation (see FIG. 2(*b*)). The annular switch projection 38 of the nozzle cap 19 and the lower annular deep groove 29 and the upper annular shallow groove 30 having the annular curved protrusion 28 therebetween constitute the ventilation passage switching means according to the present invention.

The double container cap 10 according to the first embodiment achieves ventilation of the space 20 during storage of the container and discharge of the hair dye on use of the container by an easy switching operation of vertically sliding the nozzle cap 19 on the main cap 17.

That is, while the container is stored, the nozzle cap 19 is pressed and slid down toward the main cap 17. Then as shown in FIG. 2(*a*) the flow passage S from the flow opening 16 through the central flow path 33 to the discharge outlet 18 is shut by the tip of the rod plug 25 plugged tight in the discharge outlet 18. Since the annular switch projection 38 is fitted loose in the lower annular deep groove 29 to secure a gap, the ventilation passage R from the ventilation hole 12 through the gas-leading channel 32 and the gas-leading hole 31 to the open air outside the bottle 11 is kept open.

On the other hand, when the container is used, the nozzle cap 19 is slid on the main cap 17 upward so that the annular switch projection 38 may jump over the annular curved protrusion 28. Then as shown in FIG. 2(*b*) the rod plug 25 is plugged down off the discharge outlet 18 thereby to release the clogged state of the flow passage S. At the same time the annular switch projection 38 is tightly fitted into the upper annular shallow groove 30 thereby to shut the ventilation passage R to the outside open air.

Figure 4:
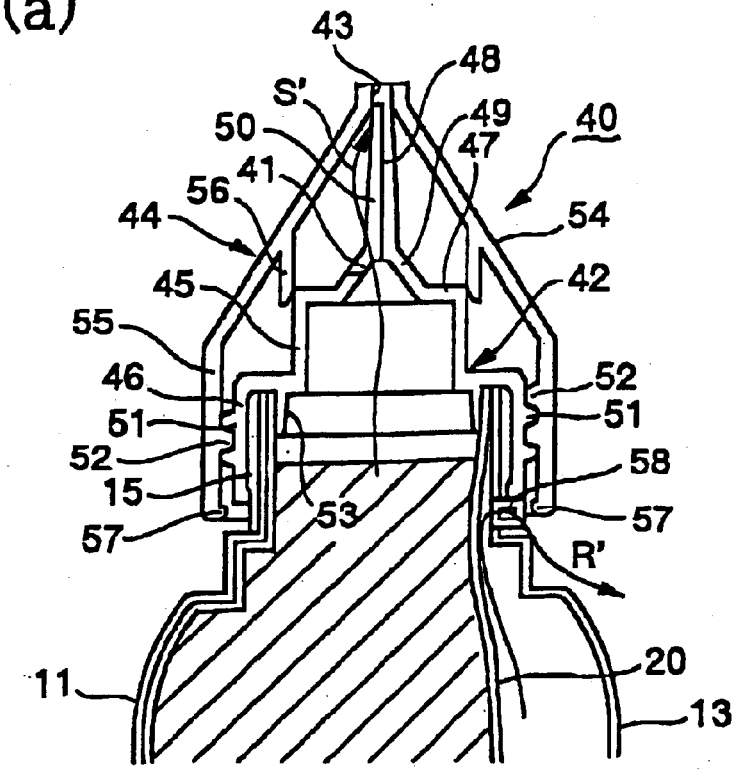
FIG. 4(*a*) is a cross-section of the essential part of a double container with a cap according to a second embodiment of the present invention fitted on, the container being in storage.
Figure 4:
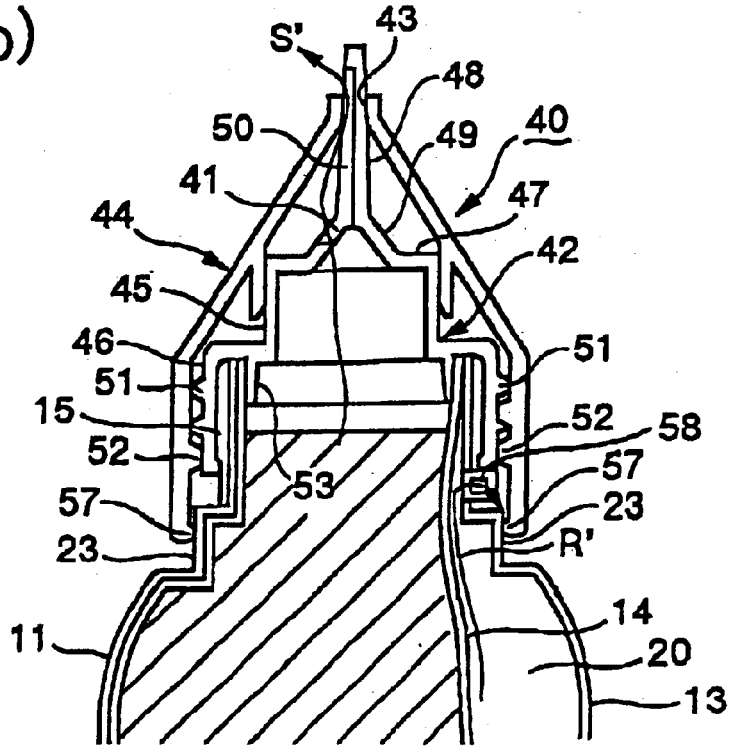

FIGS. 4(*a*) and 4(*b*) show a double container cap 40 according to the second embodiment of the present invention. The double container cap 40 of the second embodiment is composed of a main cap 42 which has a flow opening 41 for hair dye and is fixedly fitted on the neck 15 of the bottle 11 and a nozzle cap 44 which has a discharge outlet 43 for the hair dye and is slid along the thread in the peripheral direction and is thereby vertically movable on the main cap 42.

The main cap 42 is composed of an upper cylinder 45 having a smaller diameter and a lower cylinder 46 having a larger diameter. The upper cylinder 45 has a rod plug 48 standing upright on the center of its top plate 47. The rod plug 48 constitutes the flow passage switching means. The basal part of the rod plug 48 has an increased diameter to form a hollow cone 49. The flow opening 41 is made on the lateral surface of the hollow cone 49. A discharge guide channel 50 which connects with the flow opening 41 is continuously engraved in the vertical direction along the lateral surface of the plug rod 48 until it reaches near the upper end portion of the rod plug 48. The lower cylinder 46 has on the inner peripheral surface thereof a rib for fixing, whereby the main cap 17 is fixedly fitted on the neck 15. The lower cylinder 46 has on the outer peripheral surface thereof a male thread 51, on which a female thread 52 formed on the inner peripheral surface of the nozzle cap 44 is screwed. An inner ring 53 projects downward from below the upper cylinder 45.

The nozzle cap 44 is a hollow member composed of a conical portion 54 integrally connected to a lower cylinder 55. The cylinder 55 has on the inner peripheral surface thereof the female thread 52, which is screwed on the male thread 51 of the main cap 17. The nozzle cap 44 is slidably turnable on the main cap 42 along these threads in the peripheral direction and thereby vertically movable. The discharge outlet 43 is bored at the vertex of the conical portion 54 of the nozzle cap 44. An annular contact wall 56 hangs down from approximately the middle of the inner side of the conical portion 54. While keeping close contact with the outer peripheral surface of the upper cylinder 45 of the main cap 42, the annual contact wall 56 slides thereon as the nozzle cap 44 moves vertically. The lower opening edge of the cylinder 55 projects radially inward to form an annular switch projection 57 for opening and shutting the ventilation passage. With the nozzle cap 44 screwed slid down on the main cap 42, the annular switch projection 57 comes into intimate contact with the outer peripheral surface of the basal part 23 of the neck 15 of the bottle 11. The annular switch projection 57 and the basal part 23 constitute the ventilation passage switching means.

According to the second embodiment, since a ventilation hole 58 is made in the neck 15 of the bottle 11 at a position below the fixedly fitted main cap 42, where the nozzle cap 44 is in a slid up state on the main cap 42, there is secured a ventilation passage R' connecting the space 20 to the outside open air through the ventilation hole 58. Where the nozzle cap 44 is in a slid down state on the main cap 42, the annular switch projection 57 comes into hermetic contact with the outer peripheral surface of the basal part 23 thereby to shut the ventilation passage R'.

The double container cap 40 according to the second embodiment also achieves ventilation of the space 20 during storage of the container and discharge of the hair dye on use of the container by an easy switching operation of slidably turning the nozzle cap 44 on the main cap 42 in the peripheral direction.

That is, while the container is stored, the nozzle cap 44 is turned around the main cap 42 to slide upward. Then as shown in FIG. 4(*a*) a flow passage S' from the flow opening 41 to the discharge outlet 43 is shut by the tip of the rod plug 48 plugged tight in the discharge outlet 43. Simultaneously, the annular switch projection 57 lifts apart from the basal part 23, thereby to form the ventilation passage R' from the space 20 to the outside open air through the ventilation hole 58.

On the other hand, when the container is used, the nozzle cap 44 is turned around the main cap 42 to slide downward. Then as shown in FIG. 4(*b*) the tip of the rod plug 43 emerges from the discharge outlet 43, and the tip of the discharge guide channel 50 is positioned above the discharge outlet 43. As a result, the flow passage S' is opened. At the same time the annular switch projection 57 of the nozzle cap 44 comes into hermetic contact with the outer peripheral surface of the basal part 23 of the bottle 11, thereby shutting off the ventilation passage R' from the space 20 to the outside open air through the ventilation hole 58.

The present invention is not limited to the above-described embodiments, and various modifications can be made therein. For example, the contents to be put into the inner bag are not limited to those containing a component which decomposes to evolve gas, and the inner bag does not always need to have permeability to decomposition gas generated from a decomposable component of the contents. Further, various structures can be used as the flow passage switching means and the ventilation passage switching means.

INDUSTRIAL APPLICABILITY

The cap for a double container according to the present invention achieves ventilation of a space in the double container during storage of the container and discharge of the contents on use of the double container by an easy switching operation.

What is claimed is:

1. A cap for a double container comprising a flexible outer container and an inner bag for containing the contents with a space between said outer container and said inner bag and having in the neck thereof a ventilation hole interconnecting with said space, wherein:

the cap is composed of a main cap which has a flow opening and is fixedly fitted on the neck of said double container and a nozzle cap which has a discharge outlet and is slidably fitted on said main cap, and the cap has a flow passage switching means for opening and shutting the flow passage of the contents from said flow opening to said discharge outlet by sliding movement of said nozzle cap on said main cap, and a ventilation passage switching means for opening and shutting the ventilation passage from said ventilation hole to open air outside said double container by said sliding movement, such that said sliding movement makes a switch between a state with said flow passage shut and said ventilation passage open and a state with said flow passage open and said ventilation passage shut.

2. The cap for a double container according to claim 1, wherein the contents contained in said inner bag contain a component which decomposes to generate gas, and said inner bag has permeability to decomposition gas generated by said component.

3. The cap for a double container according to claim 1, wherein said ventilation passage is formed from said ventilation hole covered with said main cap to outside open air through said main cap, and said ventilation passage switching means is to make a switch by said sliding movement between a tight-fit state and a loose-fit state of the inner peripheral surface of the lower end of said nozzle cap to the outer peripheral surface of said main cap thereby to shut or open said ventilation passage.

4. The cap for a double container according to claim 1, wherein said ventilation hole is made below said main cap, said ventilation passage is formed from said ventilation hole to outside open air, and said ventilation passage switching means is capable of making a switch by said sliding movement in the state of tight contact of the inner peripheral surface of the lower end of said nozzle cap with the outer peripheral surface of said neck below said ventilation hole and thereby opening and shutting said ventilation passage.

5. The cap for a double container according to claim 2, wherein said ventilation passage is formed from said ventilation hole covered with said main cap to outside open air through said main cap, and said ventilation passage switching means is to make a switch by said sliding movement between a tight-fit state and a loose-fit state of the inner peripheral surface of the lower end of said nozzle cap to the outer peripheral surface of said main cap thereby to shut or open said ventilation passage.

6. The cap for a double container according to claim 2, wherein said ventilation hole is made below said main cap, said ventilation passage is formed from said ventilation hole to outside open air, and said ventilation passage switching means is capable of making a switch by said sliding movement in the state of tight contact of the inner peripheral surface of the lower end of said nozzle cap with the outer peripheral surface of said neck below said ventilation hole and thereby opening and shutting said ventilation passage.

* * * * *